US007013513B2

(12) United States Patent
Chow

(10) Patent No.: US 7,013,513 B2
(45) Date of Patent: Mar. 21, 2006

(54) WATERBED STRUCTURE

(76) Inventor: Andy S. Chow, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 11/046,808

(22) Filed: Feb. 1, 2005

(65) Prior Publication Data

US 2005/0166327 A1 Aug. 4, 2005

(30) Foreign Application Priority Data

Feb. 3, 2004 (CN) ..... 200420003341 U

(51) Int. Cl.
*A47C 27/10* (2006.01)

(52) U.S. Cl. ..... 5/655; 6/682; 6/687

(58) Field of Classification Search ..... 5/665, 5/669, 681–682, 687
See application file for complete search history.

(56) References Cited

U.S. PATENT DOCUMENTS 5,845,353 A * 12/1998 Chow ..... 5/685
6,035,470 A * 3/2000 Chow ..... 5/687
6,343,393 B1 * 2/2002 Chow ..... 5/681

* cited by examiner

*Primary Examiner*—Heather Shackelford
*Assistant Examiner*—Fredrick Conley

(57) ABSTRACT

A waterbed structure according to the invention comprises a water-containing body, long air protection borders, and a bed housing having a frame-shaped protection accommodating chamber. Each of the long air protection borders has transverse pull strips at a side thereof. The transverse strips have side edges thereof molded to side walls of the long air protection borders using high-cycle heat, and are disposed at interiors of the long air protection borders. The bed housing has a frame-shaped protection accommodating chamber, which is provided with at least an aperture at an appropriate position at an inner or outer side thereof for placing the aforesaid long air protection border. Furthermore, the bed housing is devised with attaching devices for joining with a long air protection border, thereby preventing the air protection borders from expanding outward for lengthening usage lifespan of the waterbed.

7 Claims, 7 Drawing Sheets

WATERBED STRUCTURE

BACKGROUND OF THE INVENTION (a) Field of the Invention

The invention relates to a waterbed structure, and more particularly, to a waterbed structure, which is capable of appropriately increasing a length of a bed body thereof as desired and preventing protective air protection borders thereof from expanding outward, thereby lengthening usage lifespan of the waterbed.

(b) Description of the Prior Art

Referring to FIG. 1 showing an elevational schematic view of a prior double waterbed, the prior waterbed comprises left and right water-containing bodies 1 and bed housing 2. Each of the water-containing body 1 has an outer layer 11; a water inlet plug 12 at an appropriate position of each outer layer 11 and for filling in water; a plurality of equidistant and parallel transverse pull strip spacers 13 that are loop-like and hollow structures; and a water opening 14 disposed at an appropriate position of each transverse pull strip spacer 13 and for allowing injected water to flow through. In addition, upper and lower edges of the transverse pull strip spacers 13 are molded with inner walls of the outer layers 11 of the water-containing bodies 1 using high-cycle heat. The bed housing 2 has an upper surface thereof provided with a plurality of disassembling openings 21 for installing or taking out the aforesaid unfilled water-containing bodies 1 by folding and compressing the water-containing bodies 1 and via the openings 21. Moreover, the water inlet plugs 12 are exactly located at the openings 21 to facilitate injecting water into the water-containing bodies 1. Around the bed housing 2 are air protection borders 3 in form of a continuous frame body. The air protection borders 3 have an air inlet plug 31 for injecting air, and a central air spacer 33 disposed longitudinally to have an overall structure formed as a shape of a square. That is, the air protection borders 3 are constructed with two accommodating chambers 32 for accommodating the two aforesaid water-containing bodies 1 therein. However, the aforesaid structure has several shortcomings below:

1. According to the prior water bed structure, the bed housing and the air protection borders are a formed integral. Supposed wear of either the bed housing or the air protection borders occur after long-term use, it is obliged to replace both the bed housing and the air protection borders as they are an integral structure. Thus, material costs are increased to lower practicability of the water bed.
2. When the water bed structure is in assembly, the openings of the bed housing and the air inlet plugs of the air protection borders are exposed, such that esthetical values of an overall appearance of the water bed are reduced.
3. After a certain period of usage of the prior water bed structure, the air protection borders are likely to dilate to further shorten usage lifespan of the water bed.

Therefore, the inventor provided an advanced waterbed structure. The inventor's prior waterbed of the invention although indeed improves replacement conveniences of the air protection borders and enhances overall practicability of the waterbed, a few shortcomings are nevertheless discovered when put to application:

1. The air protection borders are oval-shaped designs without any reinforcement. Therefore, the air protection borders are likely to expand outward, and usage lifespan of the waterbed is hence shortened.

2. The waterbed has fixed dimensions, and is incapable of increasing length or area thereof. Thus, practical and utilization values are limited.

Therefore, in view of the aforesaid drawbacks of the prior inventions, it is essential to provide a novel and more practical waterbed structure, which overcomes the aforesaid drawbacks and can be more extensively applied to conform to industrial requirements.

SUMMARY OF THE INVENTION

The primary object of the invention is to provide a waterbed structure having transverse pull strips at long air protection borders and attaching devices at all sides of a bed housing thereof, thereby preventing the air protection borders from expanding outward, and lengthening usage lifespan of the waterbed as well as appropriately increasing length and area of the waterbed as desired.

A waterbed structure according to the invention comprises a water-containing body, long air protection borders, and a bed housing having a frame-shaped protection accommodating chamber. The water-containing body is provided with a plurality of pull strip spacers, at least one water inlet plug and at least one air outlet plug, thereby facilitating a user to simultaneously fill in water and discharging air. Each of the long air protection borders is a longitudinal rectangular shape; and is devised with at least one air inlet plug at an appropriate position at an upper surface thereof, and transverse pull strips at a side thereof. The transverse strips have side edges thereof molded to side walls of the long air protection borders using high-cycle heat, and are disposed at interiors of the long air protection borders. The bed housing has a plurality of openings at appropriate positions at an upper surface thereof, wherein the openings are for installing or taking out the aforesaid unfilled and folded water-containing body. In addition, the water inlet plugs are and air outlet plugs are exactly located correspondingly to the openings, so as to facilitate filling water into the water-containing body or to discharge internal air out of the water-containing body. The bed housing further has a frame-shaped protection accommodating chamber, which is provided with at least an aperture at an appropriate position at an inner or outer side thereof for placing the aforesaid long air protection border. The protection accommodating chamber also has round orifices at appropriate positions at an upper surface thereof, such that the air inlet plugs of the long air protection borders are exactly located at the round orifices. Furthermore, the bed housing is devised with attaching devices for joining with a long air protection border, thereby increasing length and area of the overall waterbed.

DETAILED DESCRIPTION OF THE PREFERRED EMBODIMENTS

To better understand effects, structures and characteristics of the invention, a preferred embodiment shall be described with the accompanying drawings below.

Figure 1:
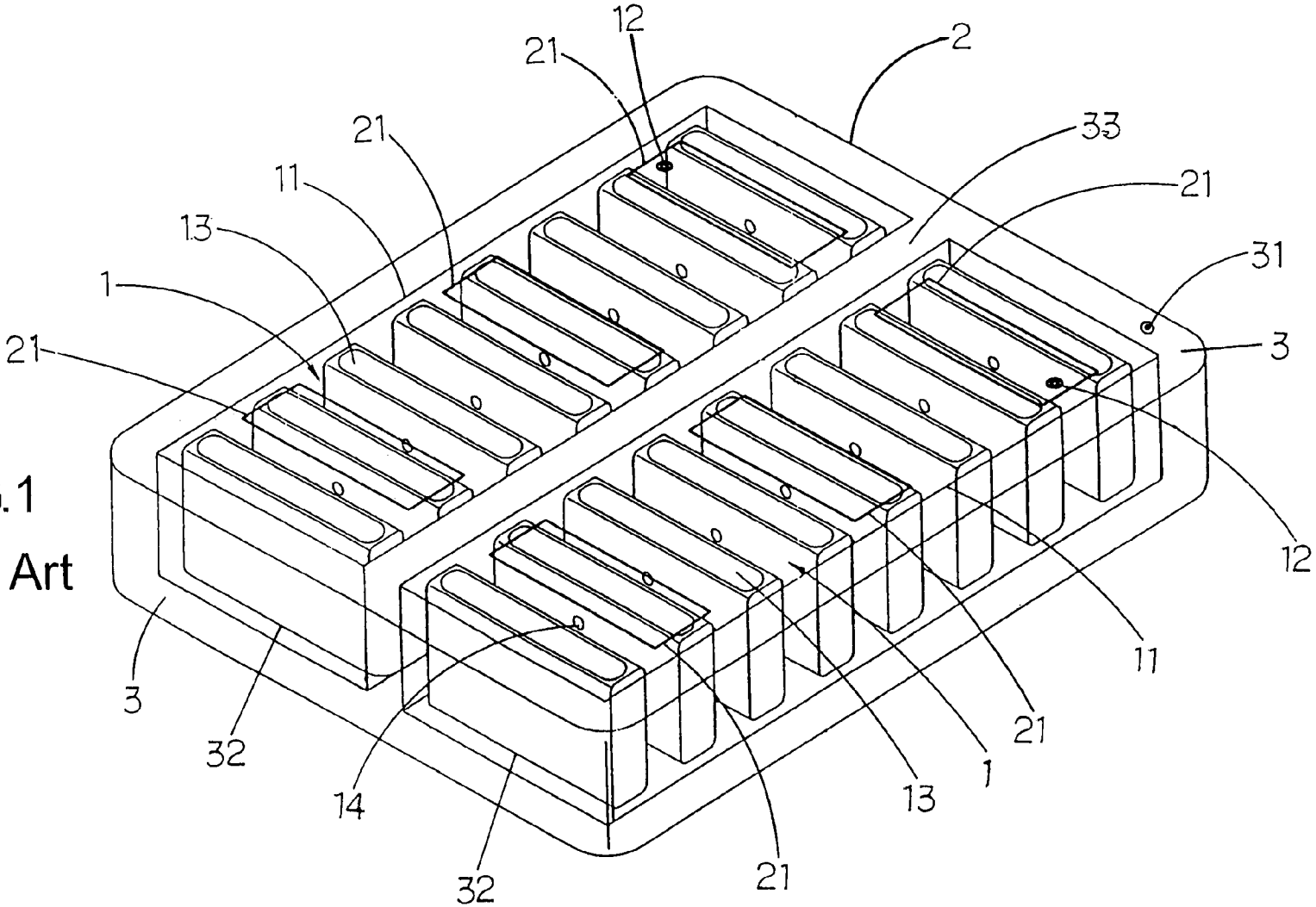
FIG.1 Prior Art
FIG. 1 shows an elevational schematic view of a prior double bed.
Figure 2:
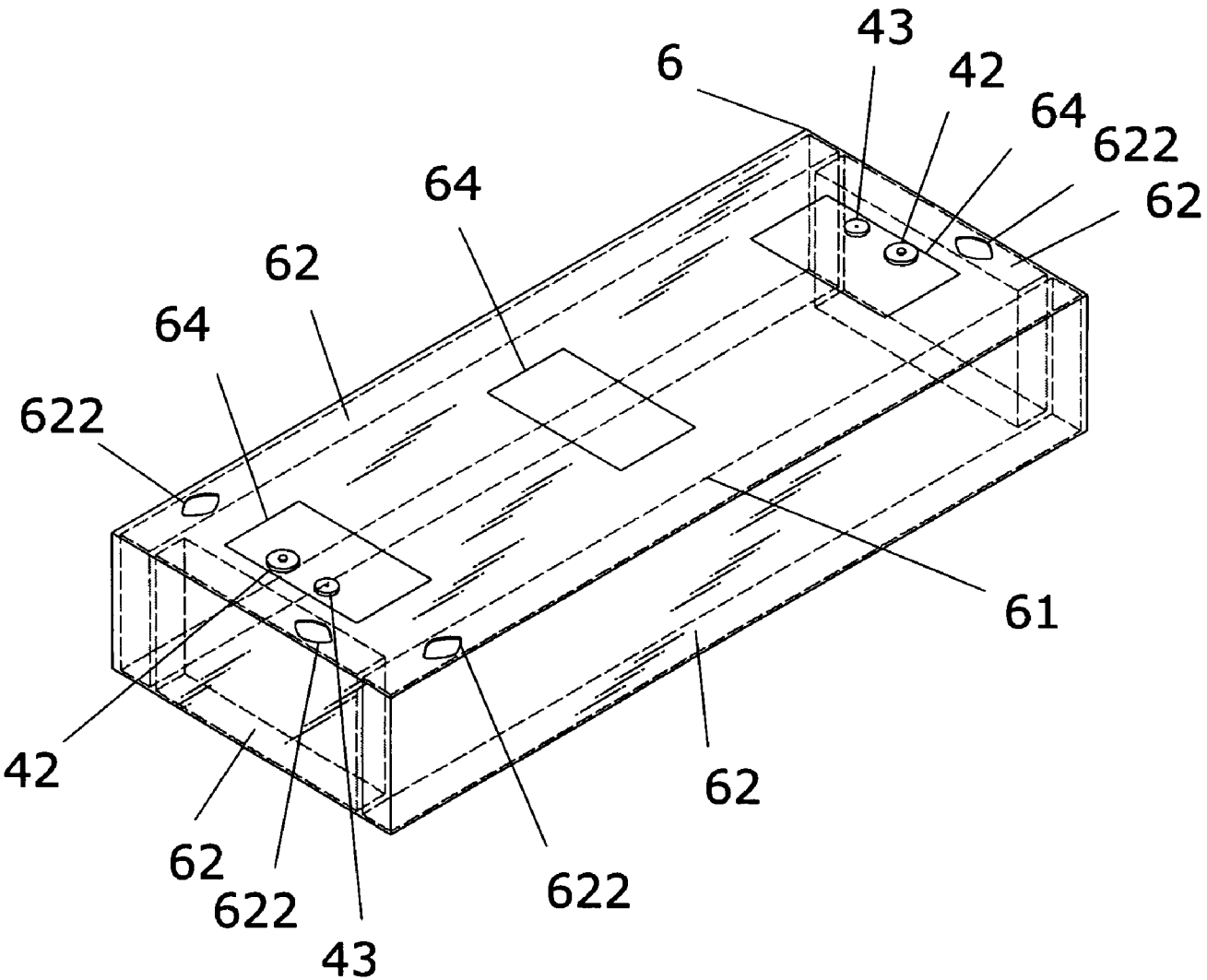
FIG. 2 shows an elevational schematic view of a single bed according to the invention.
Figure 3:
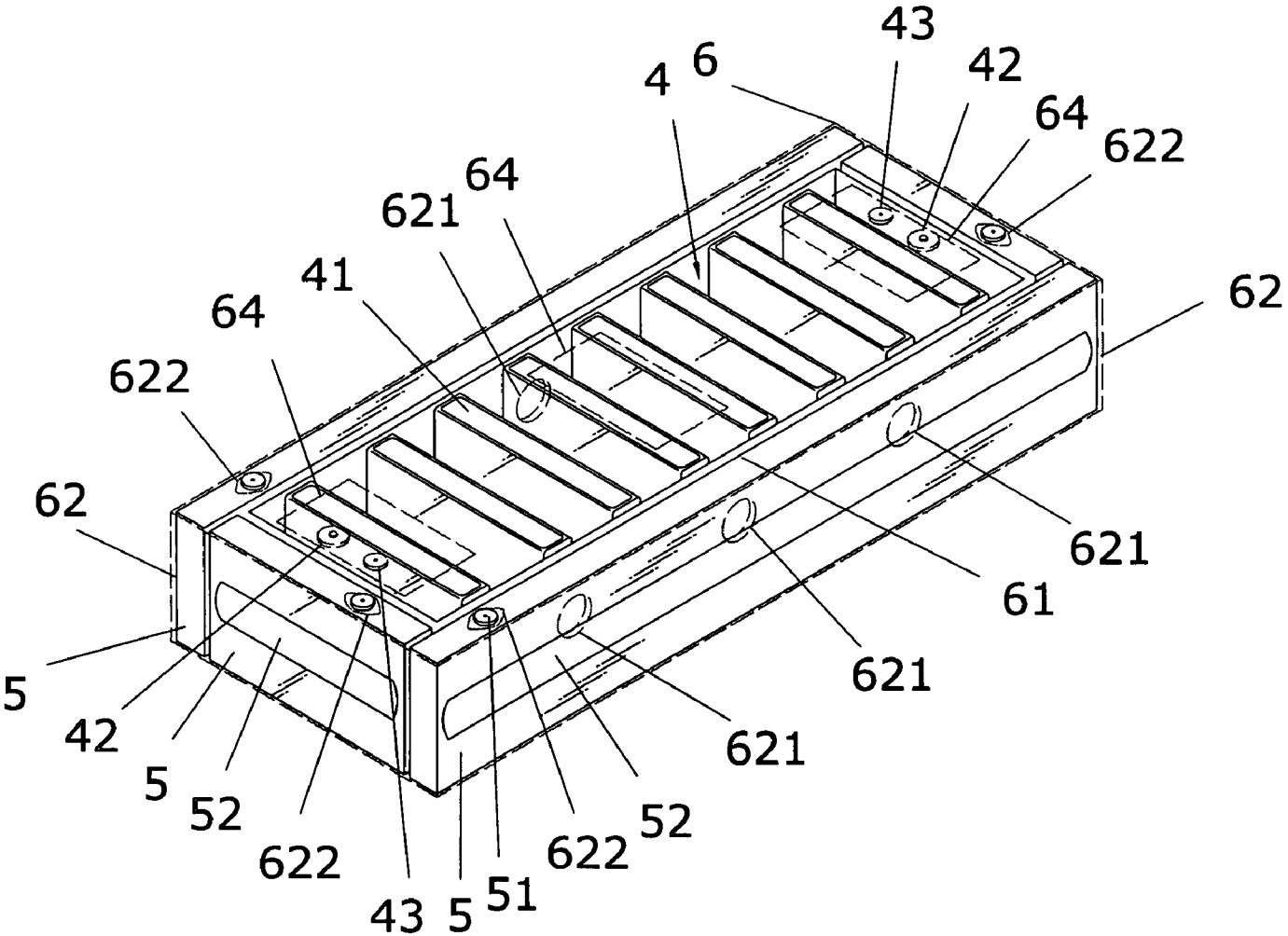
FIG. 3 shows a perspective elevational view of a single bed according to the invention in assembly.

Referring to FIGS. 2 and 3 showing elevational schematic views of a waterbed structure as an embodiment according to the invention, the waterbed comprises a water-containing body 4, long air protection borders 5, and a bed housing 6 having a frame-shaped accommodating chamber. The water-containing body 4 is provided with a plurality of pull strip spacers 41, at least a water inlet plug 42 and at least a row of air outlet plugs 43, so as to facilitate a user to simultaneously filling in water and discharging air.

Figure 4:
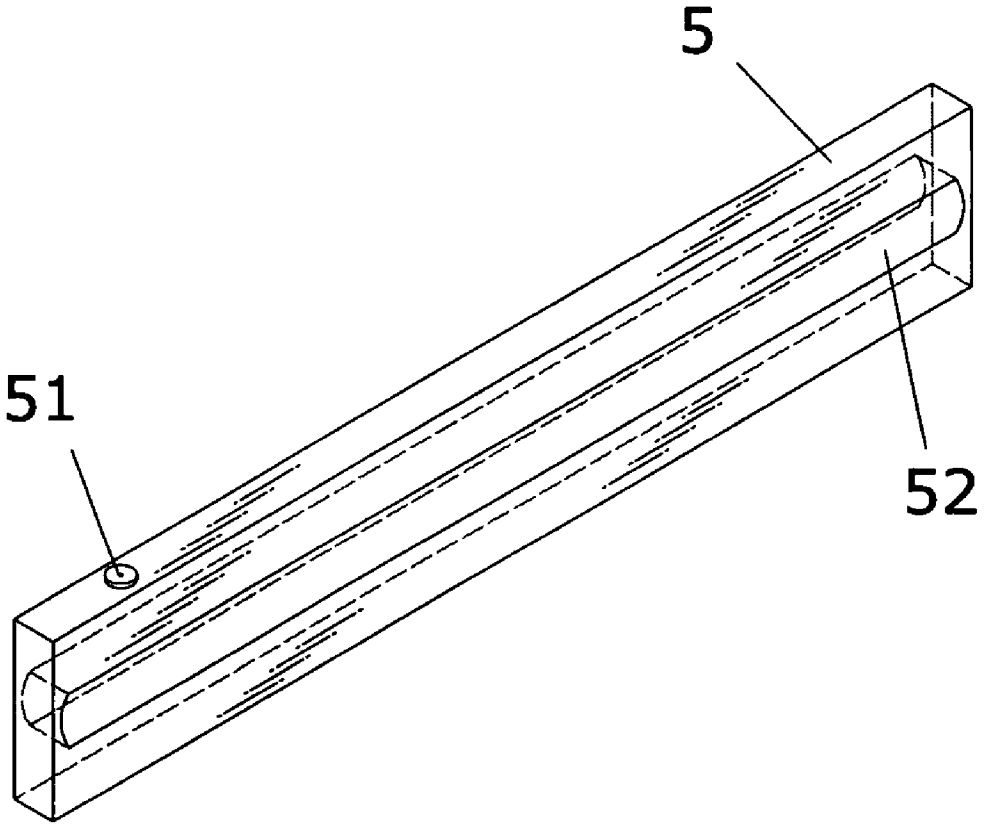
FIG. 4 shows an elevational schematic view of a long air protection border according to the invention.

Each of the long air protection strips 5 is a longitudinal rectangular shape as shown in FIG. 4. Each long air protection strip 5 is devised with at least one air inlet plug 51 at an appropriate position at an upper surface thereof, and transverse pull strips 52 at a side thereof. The transverse strips 52 have side edges thereof molded to side walls of the long air protection borders 5 using high-cycle heat, and are disposed at interiors of the long air protection borders 5.

Figure 7:
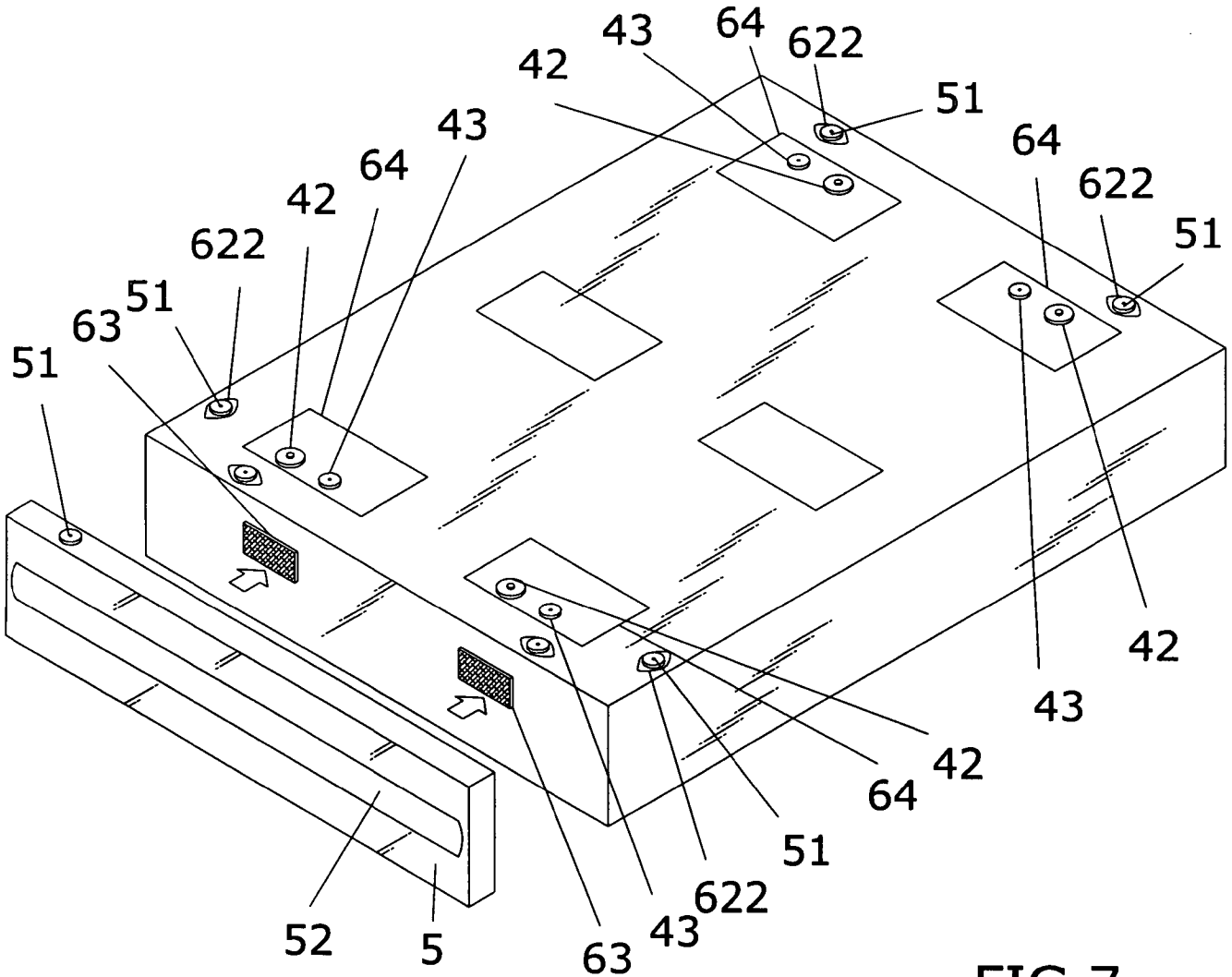
FIG. 7 shows a schematic view illustrating the attaching devices of a double bed according to the invention.

The bed housing 6 has a plurality of openings 64 at appropriate positions at an upper surface thereof, wherein the openings 64 are for installing or taking out the aforesaid unfilled and folded water-containing body 4. In addition, the water inlet plugs 42 are and air outlet plugs 43 are exactly located correspondingly to the openings 64, so as to facilitate injecting water into the water-containing body 4 or to discharge internal air out of the water-containing body 4. The bed housing 6 is formed with a accommodating chamber 61 for the water-containing body 4 at a middle section thereof for placing the water-containing body 4. The bed housing 6 further has a frame-shaped protection accommodating chamber 62, which is provided with at least an aperture 621 at an appropriate position at an inner or outer side thereof for placing the aforesaid long air protection border 5. The protection accommodating chamber 62 has a round orifice 622 at appropriate positions at an upper surface thereof, such that the air inlet plugs 51 of the long air protection borders 51 are exactly located at the round orifices 622 while also being exposed. Furthermore, referring to FIG. 7, the bed housing 6 is devised with attaching devices 63 for joining with a long air protection border 5, thereby lengthening a length and increasing an area of the overall waterbed.

Figure 5:
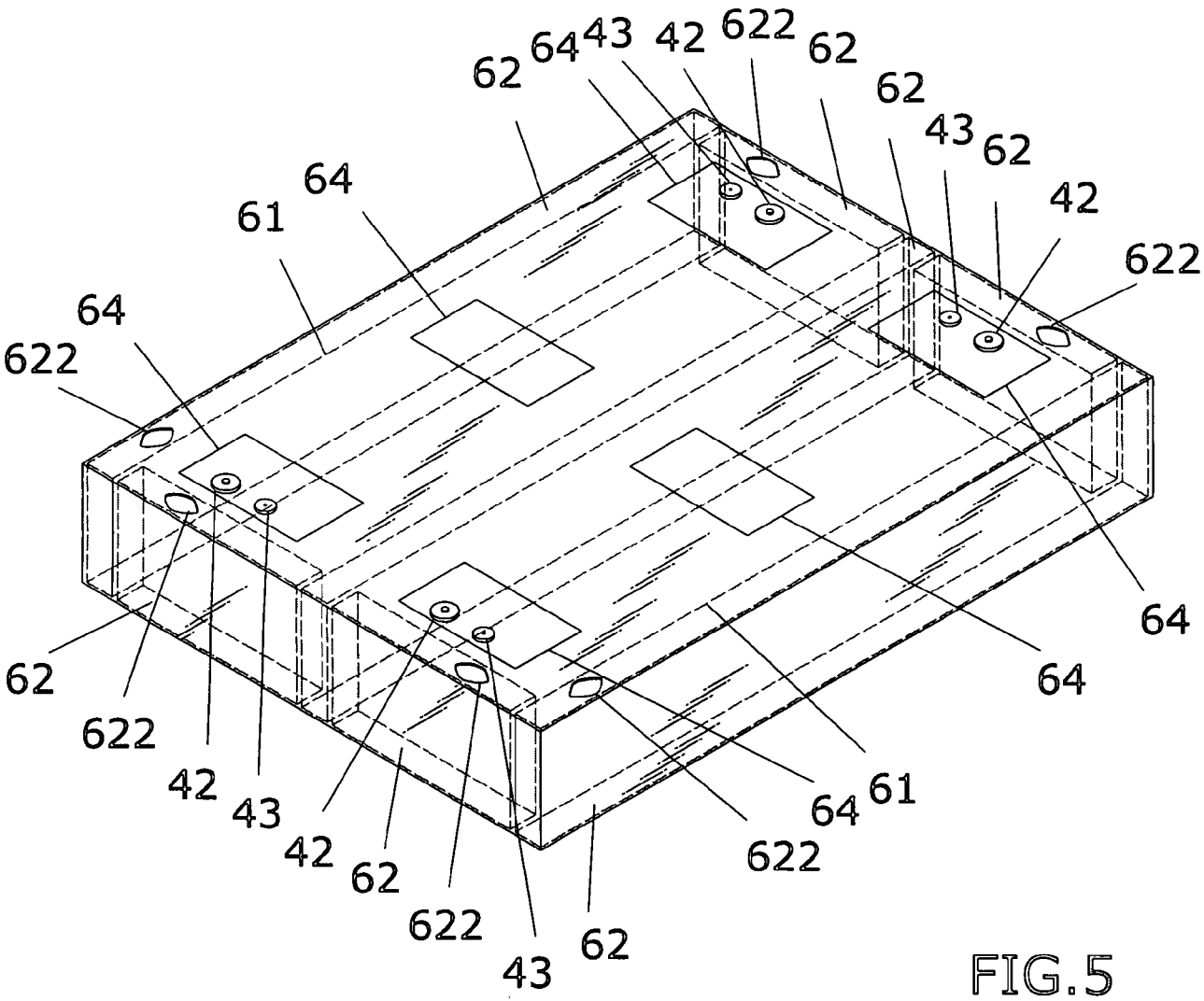
FIG. 5 shows an elevational schematic view of a double bed according to the invention.
Figure 6:
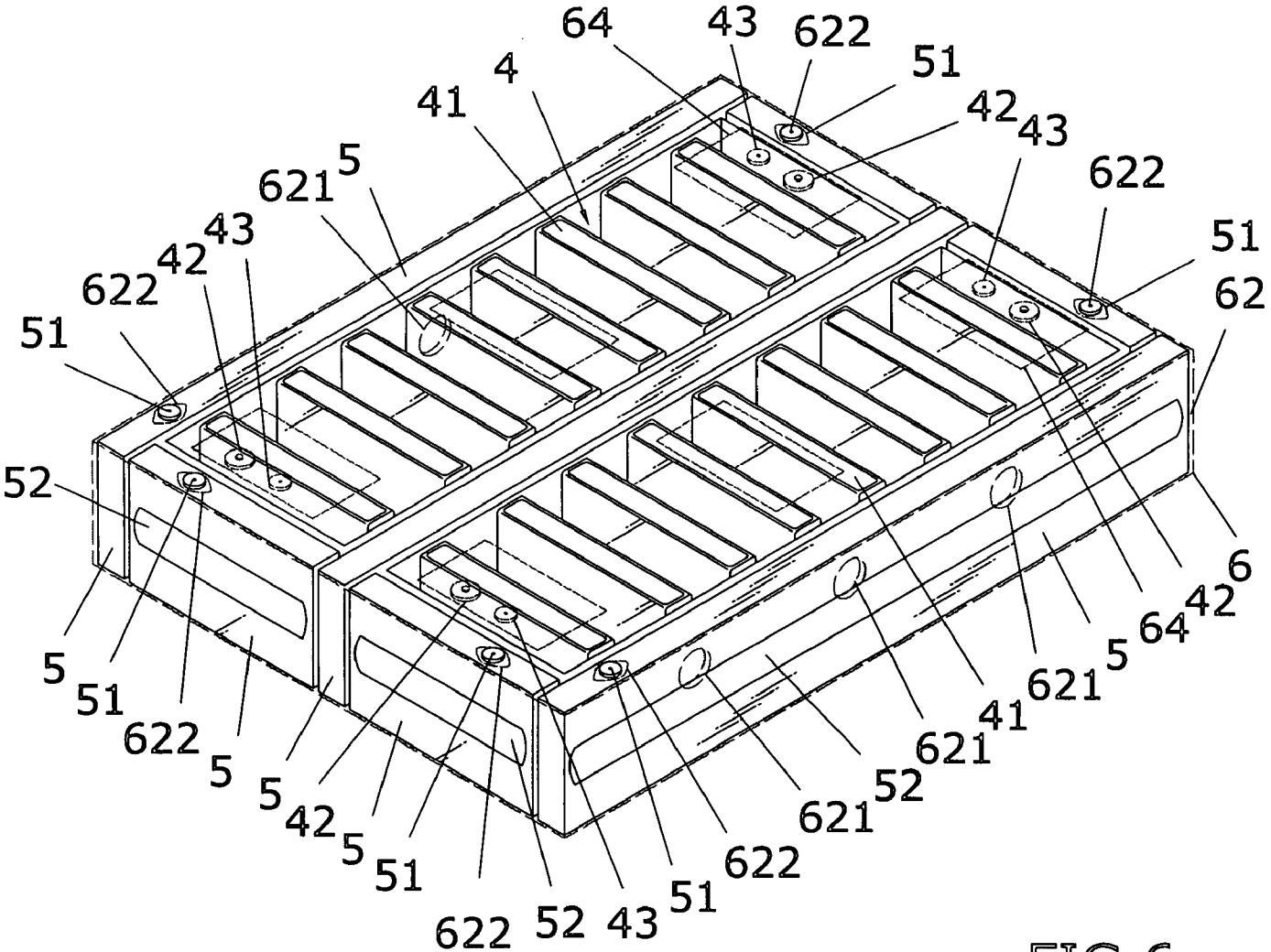
FIG. 6 shows a perspective elevational view of a double bed according to the invention in assembly.

According to the aforesaid structure, referring to FIG. 3 showing the water-containing body 4 as a single bed design, the single bed is disposed with a set of single-row of plurality of pull strip spacers 41, and the bed housing 6 appears as a rectangular body with smaller length and width for placing a water-containing body 4 having a plurality of pull strip spacers 41. Referring to FIGS. 5 and 6 showing a double bed design, the double bed is devised with left and right water-containing bodies 4. Each of the water-containing bodies 4 is placed with a plurality of pull strip spacers 41 at an interior thereof, and the bed housing 6 is provide with a frame-shaped protection accommodating chamber 62. Thus, top and bottom ends of the bed housing 6 are respectively formed with two protection chambers 62, each of which is for placing a long air protection border 5. In addition, the bed housing 6 is formed with two accommodating chambers 61 for the water-containing bodies 4, and thus two water-containing bodies 4 having pluralities of pull strip spacers 41 can be placed therein.

According to the aforementioned structure, when the long air protection borders 5 are filled with air, the long air protection borders 5 are prevented from expanding outward using disposition of the transverse pull strips 52, thereby properly maintaining an original shape thereof as well as providing long-lasting effects for lengthening usage lifespan of the waterbed. In addition, around the bed housing 6 according to the invention are attaching devices 63 for joining with a long air protection border 5. Thus, width, length and area of the overall waterbed are increased to elevate practicability and utilization values of the waterbed.

It is to be noted that, the long air protection borders 5 placed in the frame-shaped protection accommodating chamber 62 around and in the middle of the bed housing 6 can be replaced by sponge or other supportive materials, so as to provide outer parts and the middle part of the bed housing 6 erectness for giving an appealing appearance.

Moreover, around the bed housing 6 are attaching devices 63, which can be adhesive tapes or zippers.

Conclusive from the above, the waterbed according to the invention accomplishes targeted object and effects using a simple structure. Compared to prior waterbed structures, the waterbed structure according to the invention offers better practical and economical values. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A waterbed structure comprising a water-containing body, long air protection borders, and a bed housing having a frame-shaped protection accommodating chamber;

wherein, the water-containing body is provided with a plurality of pull strip spacers, at least one water inlet plug and at least one air outlet plug; and the bed housing has a plurality of openings at an upper surface thereof; and being characterized that, each of the long air protection borders has transverse pull strips at a side thereof, wherein the transverse strips have side edges thereof molded to side walls of the long air protection borders using high-cycle heat, and are disposed at interiors of the long air protection borders; the bed housing has a frame-shaped protection accommodating chamber, which is provided with at least an aperture at an appropriate position at an inner or outer side thereof for placing the aforesaid long air protection border; and around the bed housing are devised with attaching devices for joining with a long air protection border to increase length and area of the overall waterbed, thereby preventing the air protection borders from expanding outward for increasing usage lifespan of the waterbed.

2. The waterbed structure in accordance with claim 1, wherein each of the long air protection borders is provided with at least one air inlet plug at an upper surface thereof.

3. The waterbed structure in accordance with claim 1, wherein the long air protection borders are longitudinal rectangular shapes.

4. The waterbed structure in accordance with claim 1, wherein the bed housing is provided with a frame-shaped protection accommodating chamber, such that top and bottom ends of the bed housing are respectively formed with two protection chambers, each of which is for placing a long air protection border.

5. The waterbed structure in accordance with claim 1, wherein the protection accommodating chamber has round orifices at an at an upper surface thereof, such that the air inlet plugs of the long air protection borders are exactly located at the round orifices while also being exposed.

6. The waterbed structure in accordance with claim 1, wherein the long air protection borders placed in the protection accommodating chamber can be replaced by sponge or other supportive materials.

7. The waterbed structure in accordance with claim 1, wherein the attaching devices can be adhesive tapes or zippers.

* * * * *